US005992826A

United States Patent [19]

Simmonds

[11] Patent Number: 5,992,826

[45] Date of Patent: Nov. 30, 1999

[54] MOTORIZED JACK

[76] Inventor: Kevin Simmonds, 7 Lovedale Crescent, Muirkirk, United Kingdom, KA18 3QZ

[21] Appl. No.: 09/224,307

[22] Filed: Dec. 31, 1998

[51] Int. Cl.[6] ..... B66F 3/18

[52] U.S. Cl. ..... 254/103; 254/425; 254/DIG. 2

[58] Field of Search ..... 254/103, 425, 254/92, DIG. 2

[56] References Cited

U.S. PATENT DOCUMENTS

| | | | |
|---|---|---|---|
| 1,224,652 | 5/1917 | Kocourek | 254/103 |
| 5,085,407 | 2/1992 | Lonon | 254/103 |
| 5,118,082 | 6/1992 | Byun | 254/103 |

*Primary Examiner*—Timothy V. Eley
*Assistant Examiner*—Benjamin M. Halpern

[57] ABSTRACT

A motorized jack for reducing the amount of labor needed to lift up a vehicle. The motorized jack includes a housing with a motor provided in the housing. A threaded shaft is also provided in the housing. A top end of the threaded shaft is upwardly extended through a hole in the top of the housing. A ring gear is disposed around the threaded shaft. The ring gear has a toothed inner perimeter engaging the threaded shafts. An interconnected set of gears is provided in the housing to connect the ring gear to a rotating shaft of the motor. A lifting head is coupled to the top end of the threaded shaft.

20 Claims, 3 Drawing Sheets

10
11
12
13
14
15
16
17
18
19
20
21
22
36
37
38
39
44

44
+ 12
39
GND
23
M
UP
OFF
DOWN

MOTORIZED JACK

BACKGROUND OF THE INVENTION

1. Field of the Invention

The present invention relates to motorized jacks and more particularly pertains to a new motorized jack for reducing the amount of labor needed to lift up a vehicle.

2. Description of the Prior Art

The use of motorized jacks is known in the prior art. More specifically, motorized jacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,244,401; 3,392,959; 5,085,407; 4,653,727; 4,872,230; and U.S. Pat. No. Des. 99,894.

While these devices fulfill their respective, particular objectives and requirements, the aforementioned patents do not disclose a new motorized jack. The inventive device includes a housing with a motor provided in the housing. A threaded shaft is also provided in the housing. A top end of the threaded shaft is upwardly extended through a hole in the top of the housing. A ring gear is disposed around the threaded shaft. The ring gear has a toothed inner perimeter engaging the threaded shafts. An interconnected set of gears is provided in the housing to connect the ring gear to a rotating shaft of the motor. A lifting head is coupled to the top end of the threaded shaft.

In these respects, the motorized jack according to the present invention substantially departs from the conventional concepts and designs of the prior art, and in so doing provides an apparatus primarily developed for the purpose of reducing the amount of labor needed to lift up a vehicle.

SUMMARY OF THE INVENTION

In view of the foregoing disadvantages inherent in the known types of motorized jacks now present in the prior art, the present invention provides a new motorized jack construction wherein the same can be utilized for reducing the amount of labor needed to lift up a vehicle.

The general purpose of the present invention, which will be described subsequently in greater detail, is to provide a new motorized jack apparatus and method which has many of the advantages of the motorized jacks mentioned heretofore and many novel features that result in a new motorized jack which is not anticipated, rendered obvious, suggested, or even implied by any of the prior art motorized jacks, either alone or in any combination thereof.

To attain this, the present invention generally comprises a housing with a motor provided in the housing. A threaded shaft is also provided in the housing. A top end of the threaded shaft is upwardly extended through a hole in the top of the housing. A ring gear is disposed around the threaded shaft. The ring gear has a toothed inner perimeter engaging the threaded shafts. An interconnected set of gears is provided in the housing to connect the ring gear to a rotating shaft of the motor. A lifting head is coupled to the top end of the threaded shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as, they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motorized jack apparatus and method which has many of the advantages of the motorized jacks mentioned heretofore and many novel features that result in a new motorized jack which is not anticipated, rendered obvious, suggested, or even implied by any of the prior art motorized jacks, either alone or in any combination thereof.

It is another object of the present invention to provide a new motorized jack which may be easily and efficiently manufactured and marketed.

It is a further object of the present invention to provide a new motorized jack which is of a durable and reliable construction.

An even further object of the present invention is to provide a new motorized jack which is susceptible of a low cost of manufacture with regard to both materials and labor, and which accordingly is then susceptible of low prices of sale to the consuming public, thereby making such motorized jack economically available to the buying public.

Still yet another object of the present invention is to provide a new motorized jack which provides in the apparatuses and methods of the prior art some of the advantages thereof, while simultaneously overcoming some of the disadvantages normally associated therewith.

Still another object of the present invention is to provide a new motorized jack for reducing the amount of labor needed to lift up a vehicle.

Yet another object of the present invention is to provide a new motorized jack which includes a housing with a motor provided in the housing. A threaded shaft is also provided in the housing. A top end of the threaded shaft is upwardly extended through a hole in the top of the housing. A ring gear is disposed around the threaded shaft. The ring gear has a toothed inner perimeter engaging the threaded shafts. An interconnected set of gears is provided in the housing to connect the ring gear to a rotating shaft of the motor. A lifting head is coupled to the top find of the threaded shaft.

Still yet another object of the present invention is to provide a new motorized jack that is compact enough to be stored in the trunk of a passenger car.

Even still another object of the present invention is to provide a new motorized jack that may be plug into the cigarette lighter of a vehicle to power it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
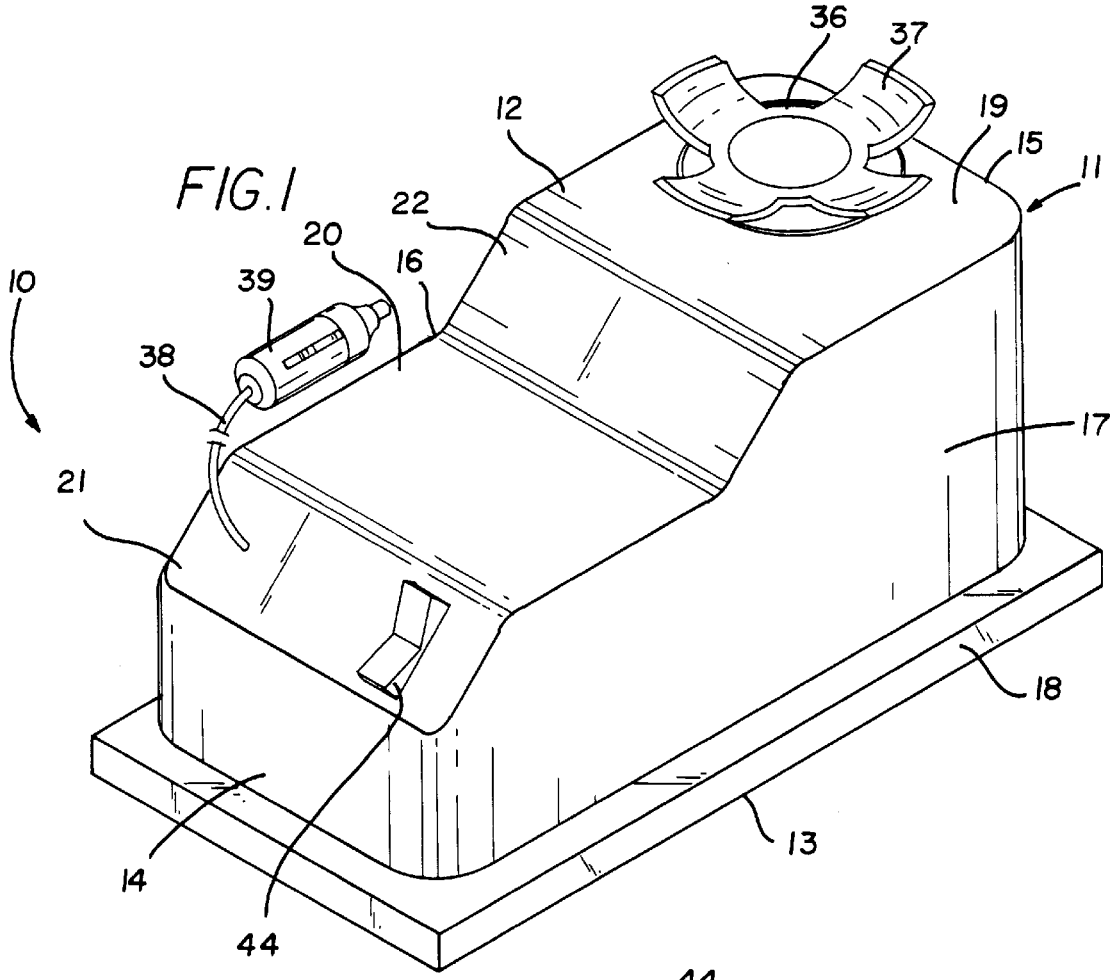
FIG. 1 is a schematic perspective of an embodiment of the motorized jack according to the present invention.

With reference now to the drawings, and in particular to FIGS. 1 through 5 thereof, a new motorized jack embodying the principles and concepts of the present invention and generally designated by the reference numeral 10 will be described.

Figure 2:
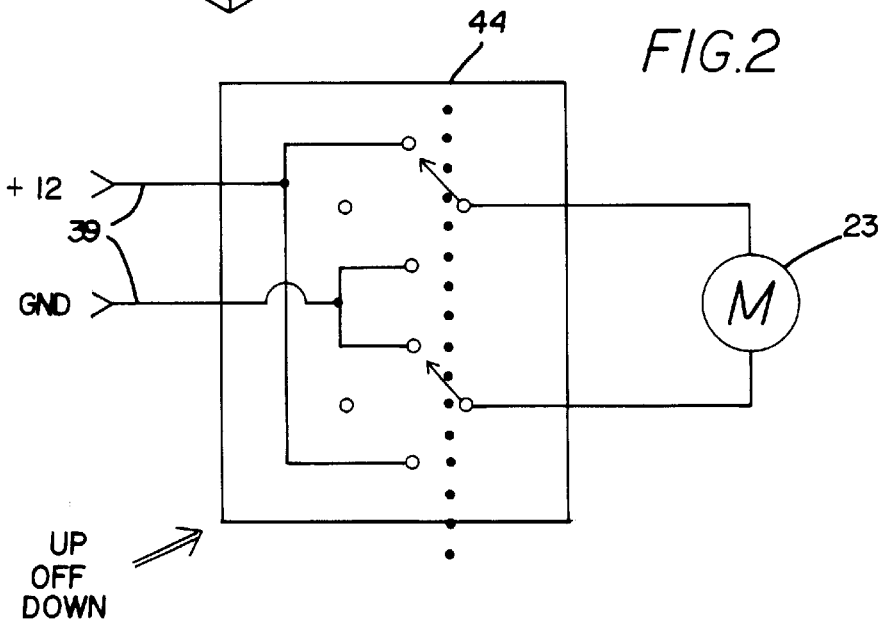
FIG. 2 is a schematic circuit diagram of the electrical system of the present invention.
Figure 3:
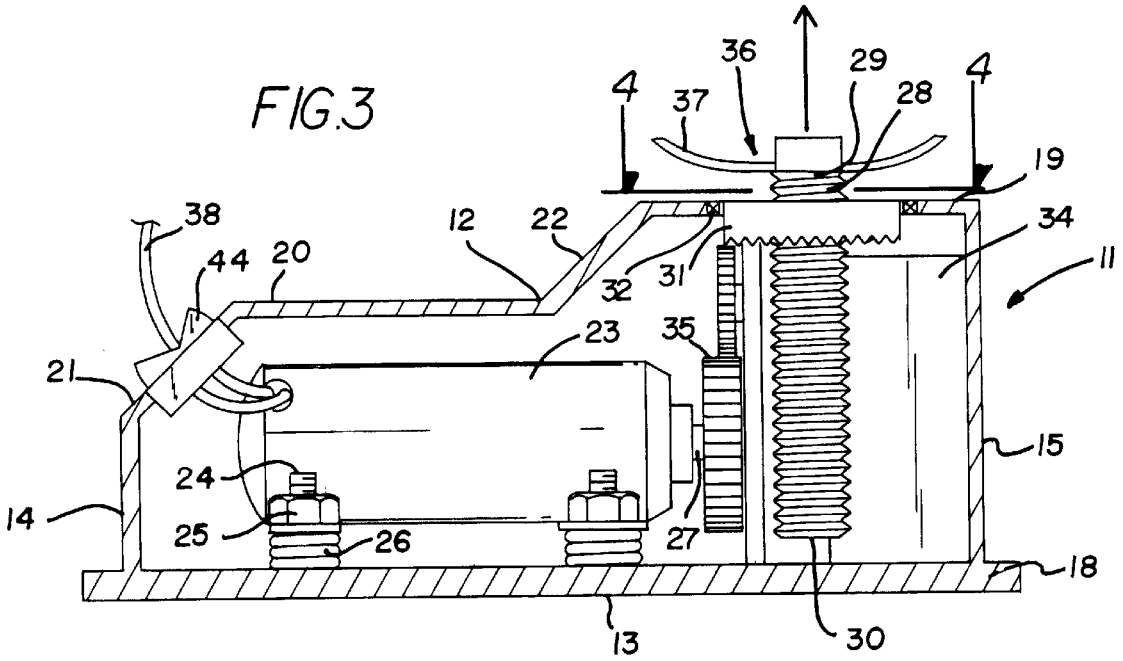
FIG. 3 is a schematic cross sectional view of the embodiment of the present invention illustrative in FIG. 1.

As best illustrated in FIGS. 1 through 3, the motorized jack 10 generally comprises a housing 11 with a motor 23 provided in the housing. A threaded shaft 28 is also provided in the housing. A top end 29 of the threaded shaft is upwardly extended through a hole in the top 12 of the housing. A ring gear 31 is disposed around the threaded shaft. The ring gear has a toothed inner perimeter engaging the threaded shafts. An interconnected set of gears 35 is provided in the housing to connect the ring gear to a rotating shaft 27 of the motor. A lifting head 36 is coupled to the top end of the threaded shaft.

In closer detail, the housing 11 of the motor zed jack 10 has a top 12, a bottom 13, proximal and distal ends 14,15, and a pair of sides 16,17. The bottom of the housing is formed by a generally rectangular metal base plate 18 for providing a stabilizing weight to the housing so that the housing does not easily tip over during use.

In one ideal embodiment, the top of the housing has generally rectangular upper and lower tiers 19,20. The upper tier 19 of the top of the housing is positioned towards the distal end 15 of the housing. The lower tier 20 of the top of the housing is positioned towards the proximal end 14 of the housing. Preferably, the upper and lower tiers of the top of the housing lie in substantially parallel planes to one another with the plane of the upper tier of the top of the housing is positioned above the plane of the lower tier of the top of the housing. The upper and lower tiers of the top of the housing and the base plate of the bottom of the housing preferably lie in substantially parallel planes to one another.

In this ideal embodiment, the proximal and distal ends of the housing preferably lie in generally parallel planes to one another. The sides of the housing lie in generally parallel planes to one another generally perpendicular to the planes of the proximal and distal ends of the housing.

Also in this ideal embodiment, the top of the housing has first and second sloped portions 21,22. The first sloped portion 21 of the top of the housing is positioned between the proximal end of the housing and the lower tier of the top of the housing. The second sloped portion 22 of the top of the housing is positioned between the upper and lower tiers of the top of the housing. The first and second sloped portions of the top of the housing lie in planes extending at acute angles to the base plate if the bottom of the housing. Preferably, the acute angles of the first and second sloped portions are about equal to one another. Ideally, the acute angles are each about 30 degrees.

A motor 23 is provided in the housing. The motor is preferably mounted to the bottom of the housing. With reference to FIG. 3, in the ideal embodiment, the base plate of the bottom of the housing has threaded mounting studs 24 upwardly extending into the housing. The motor is mounted to the mounting studs of the base plate of the bottom of the housing and secured with nuts 25 threaded onto the mounting studs. Preferably, each of the mounting studs has a coiled compression spring 25 disposed therearound such that the springs are interposed between the motor and the base plate of the bottom of the housing. The springs bias the motor away from the base plate. Preferably, the motor is positioned towards the proximal end of the housing. The motor also has an outwardly extending rotating shaft 27 which the motor rotates when energized.

A threaded shaft 28 is provided in the housing. Preferably, the threaded shaft is positioned towards distal end of the housing. The threaded shaft has top and bottom ends 29,30 and a longitudinal axis extending between the top and bottom ends of the shaft. The top end 29 of the threaded shaft is upwardly extended through a hole in the upper tier of the top of the housing so that the longitudinal axis of the threaded shaft is extended substantially perpendicular to the plane of the base panel of the bottom of the housing.

A ring gear 31 is disposed around the threaded shaft. The ring gear has a toothed inner perimeter that engages the threads of the threaded shafts. The ring gear is preferably rotatably mounted to the upper tier of the top of the housing by a bearing 32 such that the ring gear extends around the hole in the upper tier of the top of the housing.

Figure 4:
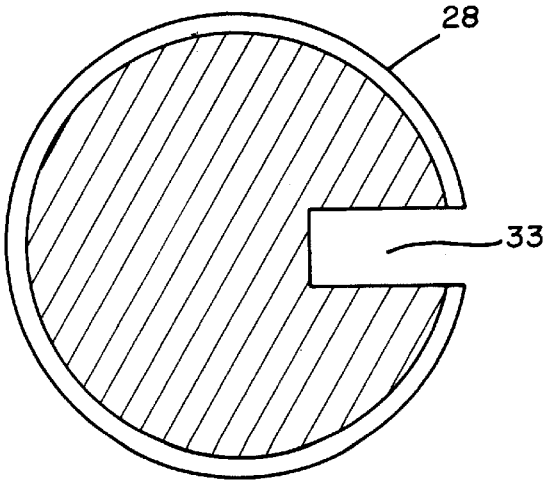
FIG. 4 is a schematic cross sectional view of the threaded shaft of the present invention taken from line 4—4 of FIG. 3.

With reference to FIG. 4, the threaded shaft has an longitudinal channel 33 extending between the top and bottom ends of the threaded shaft substantially parallel to the longitudinal axis of the threaded shaft. A generally rectangular rib plate 34 is provided in the housing. Preferably, the rib plate is coupled to both the base plate of the bottom of the housing and the distal end of the housing with the rib plate lying in a plane extending substantially perpendicular to the base plate of the bottom of the housing. One edge of the rib plate is inserted into the longitudinal channel of the threaded shaft to permit sliding of the threaded shaft along the one edge of the rib plate. The rib plate holds the threaded shaft against rotation about longitudinal axis of the threaded shaft. In use, rotation of the ring gear in a first direction advances the threaded shaft through the ring gear in an upwards direction towards the top of the housing. Conversely, rotation of the ring gear in a second direction opposite the first direction advances the threaded shaft through the ring gear in a downwards direction towards the bottom of the housing. An interconnected set of gears 35 is provided in the housing to connect the rotating shaft of the motor to the ring gear such that rotation of the rotating shaft rotates the ring gear. In use, rotation of the rotating shaft in one direction by the motor rotates the ring gear in the first direction while rotation of the rotating shaft in another direction by the motor rotates the ring gear in the second direction A lifting head 36 is coupled to the top end of the threaded shaft. In use, the lifting head is designed for positioning beneath an object to be lifted by the motorized jack. The lifting head has a plurality of arms 37 extending radially outwards from the top end of the shaft. Preferably, each of the arms of the lifting head upwardly curves from the top end of the threaded shaft to terminate at an upper end. The arms of the lifting head are curved to help hold the lifting head and object is lifted in a fixed position with respect to one another as the object is lifted.

A switch 44 is electrically connected to the motor. The switch is mounted to the top of the housing adjacent proximal end of the housing. The switch is designed for permitting selective activation of the motor and selective control of the direction the motor rotates the rotating shaft. An elongate flexible power cord 38 is outwardly extended from the housing. The power cord is electrically connected to the motor. The flexible power cord terminates at a plug 39 designed for insertion into a cigarette lighter electrical socket of a vehicle to electrically connect the motor to the electrical power supply of the vehicle.

Figure 5:
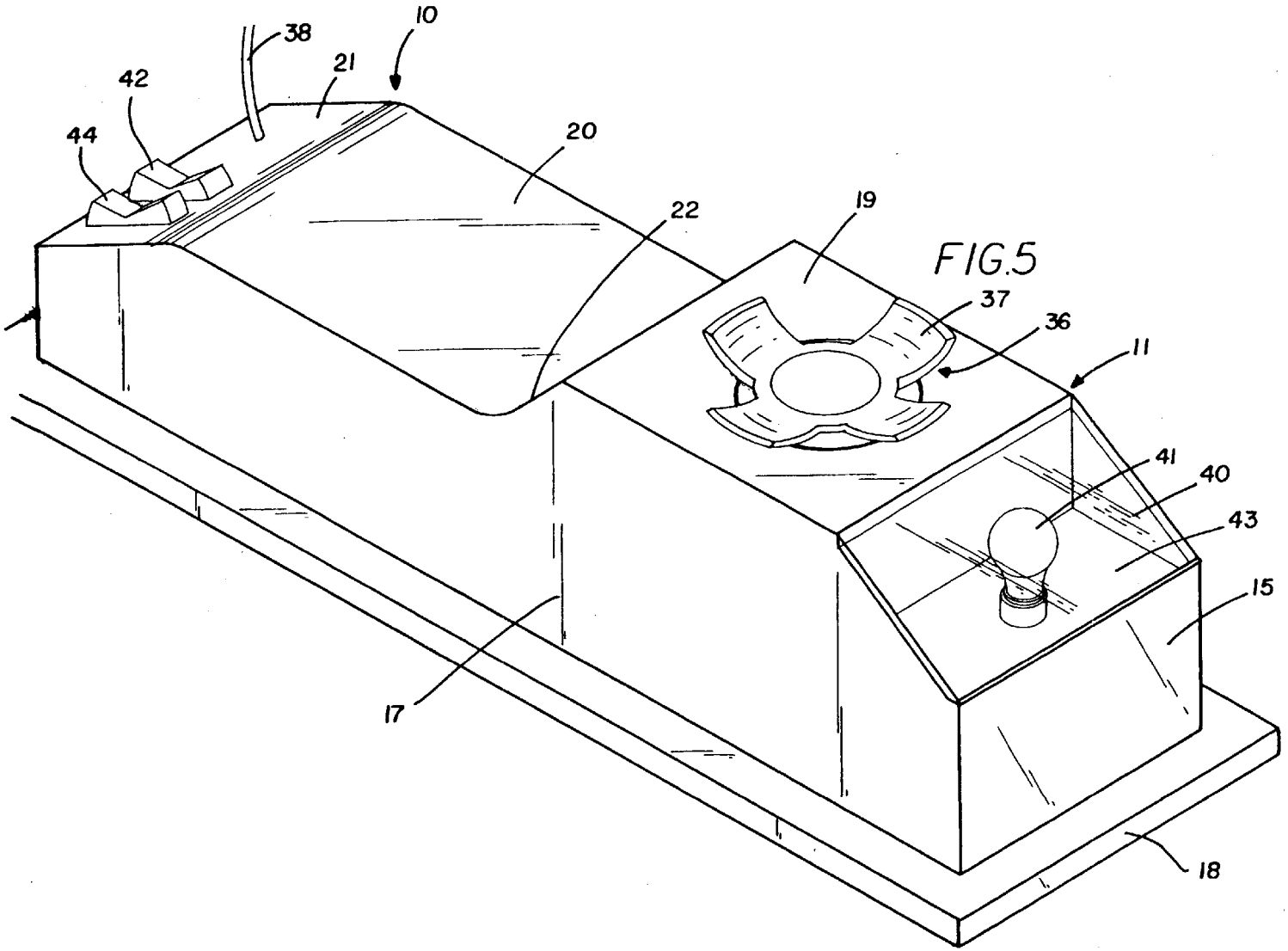
FIG. 5 is a schematic perspective view of another preferred embodiment of the present invention.

With reference to FIG. 5, in an optional preferred embodiment, the top of the housing has a translucent or generally transparent window portion 40 located adjacent distal end of the housing. The window portion of the housing is positioned between the upper tier of the top of the housing and the distal end of the housing. The window portion of the housing lies in a plane extending at an acute angle to the base plate of the bottom of the housing. Ideally, the acute angle of the plane of the window portion is about 30 degrees.

A light source 41 (such as a light bulb or an LED) is provided in the housing adjacent the window portion. This permits shining of light from the light source out of the housing through the window portion to illuminate the area around the lifting head so that a user can properly position the lifting head under an object in low light conditions. The power cord is also electrically connected to the light source to provide energy to the light source. A light switch 42 is electrically connected to the light and mounted to top of the housing. The light switch is designed for permitting selective activation of the light source.

Ideally, the light source is mounted in the housing on a reflector plate 43 with a light reflecting surface facing upwards towards the top of the housing. The reflector plate preferably lies in a plane extending generally parallel to the base plate of the bottom of the housing to help reflect light from the light source upwards through the window portion.

In an ideal illustrative embodiment, the housing has a length defined between the proximal and distal ends of the housing of about 35 cm, a width defined between the sides of the housing of about 9.5 cm and a height defined between the upper tier of the top of the housing and the base plate of the bottom of the housing of about 10 cm for providing an optimal size for conveniently storing in a trunk of a vehicle without occupying too much space in the trunk.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I calm:

1. A motorized jack, comprising:

a housing having a top, a bottom, proximal and distal ends, and a pair of sides;

a motor being provided in said housing;

said motor having an outwardly extending rotating shaft;

wherein said bottom of said housing has threaded mounting studs upwardly extending into said housing, said motor being mounted to said mounting studs of said bottom of said housing each of said mounting studs having a coiled spring disposed therearound such that said springs are interposed between said motor and said bottom of said housing, said springs biasing said motor away from said bottom of said housing;

a threaded shaft being provided in said housing;

said threaded shaft having top and bottom ends and a longitudinal axis extending between said top and bottom ends of said shaft;

said top end of said threaded shaft being upwardly extended through a hole in said top of said housing;

a ring gear being disposed around said threaded shaft, said ring gear having a toothed inner perimeter engaging said threaded shafts;

said ring gear being rotatably mounted to said top of said housing;

an interconnected set of gears being provided in said housing, said interconnected set of gears connecting said rotating shaft of said motor to said ring gear such that rotation of said rotating shaft rotates said ring gear;

a lifting head being coupled to said top end of said threaded shaft; and an elongate flexible power cord being outwardly extended from said housing, said power cord being electrically connected to said motor, said flexible power cord terminating at a plug adapted for insertion into a cigarette lighter electrical socket of a vehicle.

2. The motorized jack of claim 1, wherein said top of said housing has generally rectangular upper and lower tiers, said upper tier of said top of said housing being positioned towards said distal end of said housing, said lower tier of said top of said housing being positioned towards said proximal end of said housing.

3. The motorized jack of claim 2, wherein said upper and lower tiers of said top of said housing lie in substantially parallel planes to one another, the plane of said upper tier of said top of said housing being positioned above the plane of said lower tier of said top of said housing, and wherein said upper and lower tiers of said top of said housing and said base plate of said bottom of said housing lie in substantially parallel planes to one another.

4. The motorized jack of claim 3, wherein said top of said housing has first and second sloped portions, said first sloped portion of said top of said housing being positioned between said proximal end of said housing and said lower tier of said top of said housing, said second sloped portion of said top of said housing being positioned between said upper and lower tiers of said top of said housing, said first and second sloped portions of said top of said housing lying in planes extending at acute angles to said base plate of said bottom of said housing.

5. The motorized jack of claim 4, wherein said acute angles of said first and second sloped portions are about equal to one another.

6. The motorized jack of claim 5, wherein said acute angles are each about 30 degrees.

7. The motorized jack of claim 1, wherein said threaded shaft has an longitudinal channel extending between said top and bottom ends of said threaded shaft substantially parallel to said longitudinal axis of said threaded shaft, and wherein a generally rectangular rib plate is provided in said housing, one edge of said rib plate being inserted into said longitudinal channel of said threaded shaft to permit sliding of said threaded shaft along said one edge of said rib plate, said rib plate holding said threaded shaft against rotation about longitudinal axis of said threaded shaft.

8. The motorized jack of claim 1, wherein said lifting head has a plurality of arms extending radially outwards from said top end of said shaft, each of said arms of said lifting head upwardly curving from said top end of said threaded shaft to terminate at an upper end.

9. The motorized jack of claim 1, further comprising a switch being electrically connected to said motor, said switch being mounted to said top of said housing adjacent proximal end of said housing.

10. The motorized jack of claim 1, said top of said housing has a generally transparent window portion located adjacent distal end of said housing, and wherein a light source is provided in said housing adjacent said window portion.

11. A motorized jack, comprising:

a housing having a top, a bottom, proximal and distal ends, and a pair of sides;

said bottom of said housing comprising a generally rectangular base plate;

said top of said housing having generally rectangular upper and lower tiers, said upper tier of said top of said housing being positioned towards said distal end of said housing, said lower tier of said top of said housing being positioned towards said proximal end of said housing;

said upper and lower tiers of said top of said housing lying in substantially parallel planes to one another, the plane of said upper tier of said top of said housing being positioned above the plane of said lower tier of said top of said housing;

said upper and lower tiers of said top of said housing and said base plate of said bottom of said housing lying in substantially parallel planes to one another;

said proximal and distal ends of said housing lying in generally parallel planes to one another, said sides of said housing lying in generally parallel planes to one another generally perpendicular to the planes of said proximal and distal ends of said housing;

wherein said top of said housing has first and second sloped portions;

said first sloped portion of said top of said housing being positioned between said proximal end of said housing and said lower tier of said top of said housing;

said second sloped portion of said top of said housing being positioned between said upper and lower tiers of said top of said housing;

said first and second sloped portions of said top of said housing lying in planes extending at acute angles to said base plate of said bottom of said housing;

wherein said acute angles of said first and second sloped portions are about equal to one another, wherein said acute angles are each about 30 degrees;

a motor being provided in said housing, said motor being mounted to said bottom of said housing, wherein said base plate of said bottom of said housing has threaded mounting studs upwardly extending into said housing, said motor being mounted to said mounting studs of said base plate of said bottom of said housing, each of said mounting studs having a coiled spring disposed therearound such that said springs are interposed between said motor and said base plate of said bottom of said housing, said springs biasing said motor away from said base plate;

said motor being positioned towards said proximal end of said housing;

said motor having an outwardly extending rotating shaft;

a threaded shaft being provided in said housing, said threaded shaft being positioned towards distal end of said housing;

said threaded shaft having top and bottom ends and a longitudinal axis extending between said top and bottom ends of said shaft;

said top end of said threaded shaft being upwardly extended through a hole in said upper tier of said top of said housing;

said longitudinal axis of said threaded shaft being extended substantially perpendicular to the plan of said base panel of said bottom of said housing;

a ring gear being disposed around said threaded shaft, said ring gear having a toothed inner perimeter engaging said threaded shafts;

said ring gear being rotatably mounted to said upper tier of said top of said housing;

said threaded shaft having an longitudinal channel extending between said top and bottom ends of said threaded shaft substantially parallel to said longitudinal axis of said threaded shaft;

a generally rectangular rib plate being provided in said housing, said rib plate being coupled to said base plate of said bottom of said housing and being coupled to said distal end of said housing, said rib plate lying in a plane extending substantially perpendicular to said base plate of said bottom of said housing;

one edge of said rib plate being inserted into said longitudinal channel of said threaded shaft to permit sliding of said threaded shaft along said one edge of said rib plate, said rib plate holding said threaded shaft against rotation about longitudinal axis of said threaded shaft;

wherein rotation of said ring gear in a first direction advances said threaded shaft through said ring gear in an upwards direction towards said top of said housing, wherein rotation of said ring gear in a second direction advances said threaded shaft through said ring gear in a downwards direction towards said bottom of said housing;

an interconnected set of gears being provided in said housing, said interconnected set of gears connecting said rotating shaft of said motor to said ring gear such that rotation of said rotating shaft rotates said ring gear, wherein rotation of said rotating shaft in one direction by said motor rotates said ring gear in said first direction, wherein rotation of said rotating shaft in another direction by said motor rotates said ring gear in said second direction;

a lifting head being coupled to said top end of said threaded shaft;

said lifting head having a plurality of arms extending radially outwards from said top end of said shaft, each of said arms of said lifting head upwardly curving from said top end of said threaded shaft to terminate at an upper end;

a switch being electrically connected to said motor, said switch being mounted to said top of said housing adjacent proximal end of said housing;

an elongate flexible power cord being outwardly extended from said housing, said power cord being electrically connected to said motor, said flexible power cord terminating at a plug adapted for insertion into a cigarette lighter electrical socket of a vehicle;

said top of said housing having a generally transparent window portion located adjacent distal end of said housing;

said window portion of said housing being positioned between said upper tier of said top of said housing and said distal end of said housing;

said window portion of said housing lying in a plane extending at an acute angle to said base plate of said bottom of said housing, wherein said acute angle of said plane of said window portion is about 30 degrees;

a light source being provided in said housing adjacent said window portion;

said power cord being electrically connected to said light source; and a light switch being electrically connected to said light and mounted to top of said housing.

12. A motorized jack, comprising:

a housing having a top, a bottom, proximal and distal ends, and a pair of sides;

a motor being provided in said housing;

said motor having an outwardly extending rotating shaft;

a threaded shaft being provided in said housing;

said threaded shaft having top and bottom ends and a longitudinal axis extending between said top and bottom ends of said shaft wherein said threaded shaft has an longitudinal channel extending between said top and bottom ends of said threaded shaft substantially parallel to said longitudinal axis of said threaded shaft, and wherein a generally rectangular rib plate is provided in said housing, one edge of said rib plate being inserted into said longitudinal channel of said threaded shaft to permit sliding of said threaded shaft along said one edge of said rib plate, said rib plate holding said threaded shaft against rotation about longitudinal axis of said threaded shaft;

said top end of said threaded shaft being upwardly extended through a hole in said top of said housing;

a ring gear being disposed around said threaded shaft, said ring gear having a toothed inner perimeter engaging said threaded shafts;

said ring gear being rotatably mounted to said top of said housing;

an interconnected set of gears being provided in said housing, said interconnected set of gears connecting said rotating shaft of said motor to said ring gear such that rotation of said rotating shaft rotates said ring gear;

a lifting head being coupled to said top end of said threaded shaft; and an elongate flexible power cord being outwardly extended from said housing, said power cord being electrically connected to said motor, said flexible power cord terminating at a plug adapted for insertion into a cigarette lighter electrical socket of a vehicle.

13. The motorized jack of claim 12, wherein said top of said housing has generally rectangular upper and lower tiers, said upper tier of said top of said housing being positioned towards said distal end of said housing, said lower tier of said top of said housing being positioned towards said proximal end of said housing.

14. The motorized jack of claim 13, wherein said upper and lower tiers of said top of said housing lie in substantially parallel planes to one another, the plane of said upper tier of said top of said housing being positioned above the plane of said lower tier of said top of said housing, and wherein said upper and lower tiers of said top of said housing and said base plate of said bottom of said housing lie in substantially parallel planes to one another.

15. The motorized jack of claim 14, wherein said top of said housing has first and second sloped portions, said first sloped portion of said top of said housing being positioned between said proximal end of said housing and said lower tier of said top of said housing, said second sloped portion of said top of said housing being positioned between said upper and lower tiers of said top of said housing, said first and second sloped portions of said top of said housing lying in planes extending at acute angles to said base plate of said bottom of said housing.

16. The motorized jack of claim 15, wherein said acute angles of said first and second sloped portions are about equal to one another.

17. The motorized jack of claim 16, wherein said acute angles are each about 30 degrees.

18. The motorized jack of claim 12, wherein said bottom of said housing has threaded mounting studs upwardly extending into said housing, said motor being mounted to said mounting studs of said bottom of said housing each of said mounting studs having a coiled spring disposed thereround such that said springs are interposed between said motor and said bottom of said housing, said springs biasing said motor away from said bottom of said housing.

19. The motorized jack of claim 12, wherein said lifting head has a plurality of arms extending radially outwards from said top end of said shaft, each of said arms of said lifting head upwardly curving from said top end of said threaded shaft to terminate at an upper end.

20. The motorized jack of claim 1, further comprising a switch being electrically connected to said motor, said switch being mounted to said top of said housing adjacent proximal end of said housing.

* * * * *